US006338174B1

(12) United States Patent
Stjerna

(10) Patent No.: US 6,338,174 B1
(45) Date of Patent: Jan. 15, 2002

(54) SPRING MATTRESS

(75) Inventor: Nils Eric Stjerna, Herrljunga (SE)

(73) Assignee: Stjernfjädrar AB, Herrljunga (SE)

( * ) Notice: Subject to any disclaimer, the term of this patent is extended or adjusted under 35 U.S.C. 154(b) by 0 days.

(21) Appl. No.: 09/554,659

(22) PCT Filed: Dec. 11, 1998

(86) PCT No.: PCT/SE98/02283

§ 371 Date: Jul. 13, 2000

§ 102(e) Date: Jul. 13, 2000

(87) PCT Pub. No.: WO99/34711

PCT Pub. Date: Jul. 15, 1999

(30) Foreign Application Priority Data

Dec. 19, 1997 (SE) ..... 9704745

(51) Int. Cl.[7] ..... A47C 23/04

(52) U.S. Cl. ..... 5/716; 5/259.1; 5/267; 5/270

(58) Field of Search ..... 5/716, 259.1, 267, 5/270; 267/101, 105, 91

(56) References Cited

U.S. PATENT DOCUMENTS 1,139,892 A * 5/1915 Miller et al. ..... 5/259.1
1,261,655 A 4/1918 Vallone
1,418,469 A 6/1922 Reidenbach
4,055,337 A * 10/1977 Laiche et al. ..... 5/259.1
6,050,553 A * 4/2000 Cable et al. ..... 5/259.1

FOREIGN PATENT DOCUMENTS

| | | |
|---|---|---|
| GB | A430564 | 6/1935 |
| NO | C059281 | 4/1938 |

* cited by examiner

*Primary Examiner*—Lynne H. Browne
*Assistant Examiner*—Fredrick Conley
(74) *Attorney, Agent, or Firm*—Birch, Stewart, Kolasch & Birch, LLP

(57) ABSTRACT

A spring mattress including a number of interconnected coil spring elements, and a method of manufacturing the mattress. The spring mattress includes the coil spring elements that are interconnected by surface elements, such as strip pieces made from textile or plastic material and extending at least in one plane that is essentially in parallel with a plane of the mattress, with the strip pieces extending between and being attached to pairs of neighboring spring elements, thus interconnecting the spring elements.

9 Claims, 2 Drawing Sheets

SPRING MATTRESS

This application is the national phase under 35 U.S.C. §371 of PCT International Application No. PCT/SE98/02283 which has an International filing date of Dec. 11, 1998, which designated the United States of America.

TECHNICAL FIELD

The present invention relates to a spring mattress comprising a plurality of interconnected coil-spring elements, and to a method of manufacturing said mattress.

BACKGROUND

Conventionally, in the manufacture of spring mattresses comprising layers of coil springs arranged between the bed frame and the surface of the mattress, the springs are joined together at the spring ends. Usually springs of the kind known as Bonnell springs are used, wherein neighbouring springs are interconnected in pairs by means of spirals, which are coiled about the adjacent parts of turns in the respective adjacent spring. Thus, the spirals extend in parallel with the surface of the mattress, i.e. across the centre axes of the springs, either in the longitudinal or width direction of the mattress.

This classical mattress does, however, suffer from a number of disadvantages. Since the spirals lock turns in neighbouring springs together rather firmly, the springs fail to be individually resilient. As a result, load on one of the springs of the mattress will cause deflection not only of that spring but also of neighbouring springs. This is a disadvantage, as it detracts from the adaptability of the mattress and because the latter will not distribute the supporting force evenly across the user's entire body surface, and in consequence the mattress is felt as being less comfortable.

In addition, the spirals are wound from metal wire resulting not only in the need for a comparatively complex assembly method but also in a stiff mattress surface that may be felt as bumpy.

OBJECT OF THE INVENTION

Consequently, one object of the present invention is to provide a spring mattress of the kind defined in the introduction but wherein the disadvantages from which prior-art mattresses of this kind suffer have been completely or at least partly eliminated.

This object is achieved in a spring mattress and by means of a method of manufacturing said mattress in accordance with the present invention.

BRIEF DESCRIPTION OF THE DRAWINGS

For exemplifying purposes, some embodiments of the invention will be described in the following with reference to the accompanying drawings, wherein.

DESCRIPTION OF PREFERRED EMBODIMENTS

Figure 1:
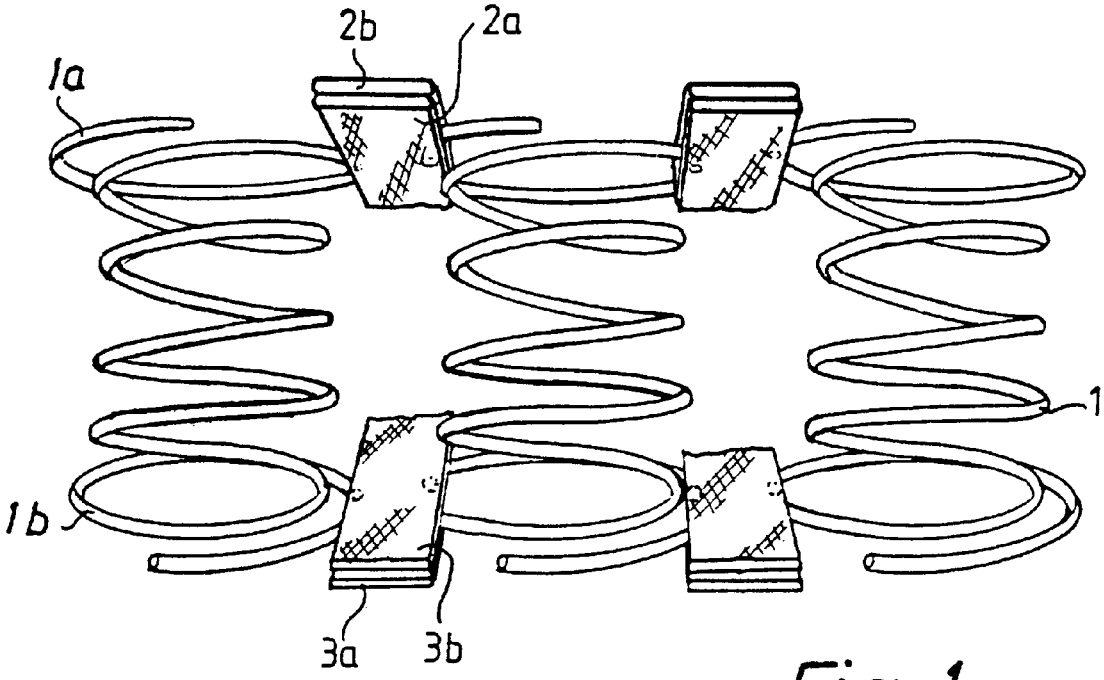
FIG. 1 is a lateral view of a part of a spring mattress in accordance with one embodiment thereof.
Figure 2:
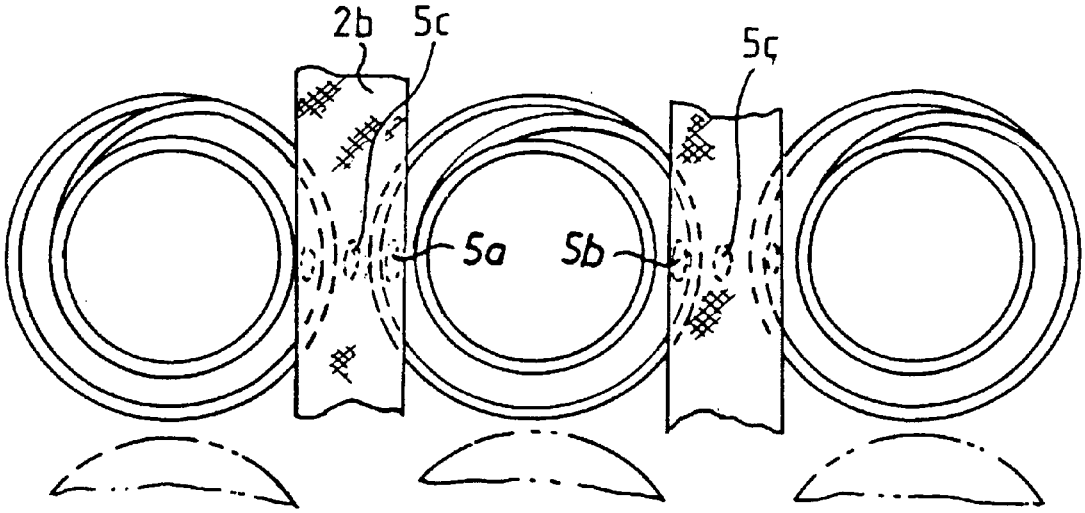
FIG. 2 is a view from above of the mattress of FIG. 1.

FIG. 1 is a lateral view of a portion of a spring mattress comprising springs in accordance with the invention, and FIG. 2 is a view from above of that same mattress. The mattress in accordance with the invention comprises a layer of coil springs 1 extending resiliently between the bed frame and the surface of the mattress.

The coil springs 1 are interconnected by strip pieces 2, which are anchored to two turns of adjacent coil springs. The thus interconnected turns of the coil springs preferably are the two end turns of each coil spring. However, it is likewise possible to instead interconnect other turns inside the spring. The turns to be interconnected preferably are larger than the rest of the turns of the spring, i.e. they have a larger radial extension. Owing this larger size, they may be interconnected without the other parts of the springs abutting against one another as the springs are exposed to load. Preferably, springs of the so called double-cone configuration are used, i.e. springs the top and bottom turns of which are wider than the rest of the turns, as is the case in conventional Bonnell spring carcasses. Finally, these turns of the spring, which are intended to be interconnected in accordance with the invention, also preferably are flat, i.e. they extend in a plane that essentially is perpendicular to the centre axis of the spring.

The strip pieces preferably are placed in pairs in such a manner that parts of the turns to be interconnected will be sandwiched between the strip pieces, whereupon said strip pieces are joined together by means of gluing or welding. Also preferably, the strip pieces bridge over a number of such pairs of adjacent coil springs.

Preferably, the strip pieces are joined together by means of spot welding. As appears from FIG. 2, for each pair of neighbouring springs, two points of attachment 5*a* and 5*b*, respectively, are located on the inside of the respective turn of the neighbouring springs, and a further point of attachment 5*c* is located intermediate the springs. In this manner the strip pieces will grippingly surround the spring wire and hold the springs together. Preferably the spacing between the attachment points is such, however, as to allow the spring wires to move somewhat, i.e. they are able to move slightly relative to one another and to the strip pieces. Owing to this arrangement, the springs are imparted at least some individual resilience, and consequently a spring may be compressed somewhat without affecting neighbouring springs.

Figure 3:
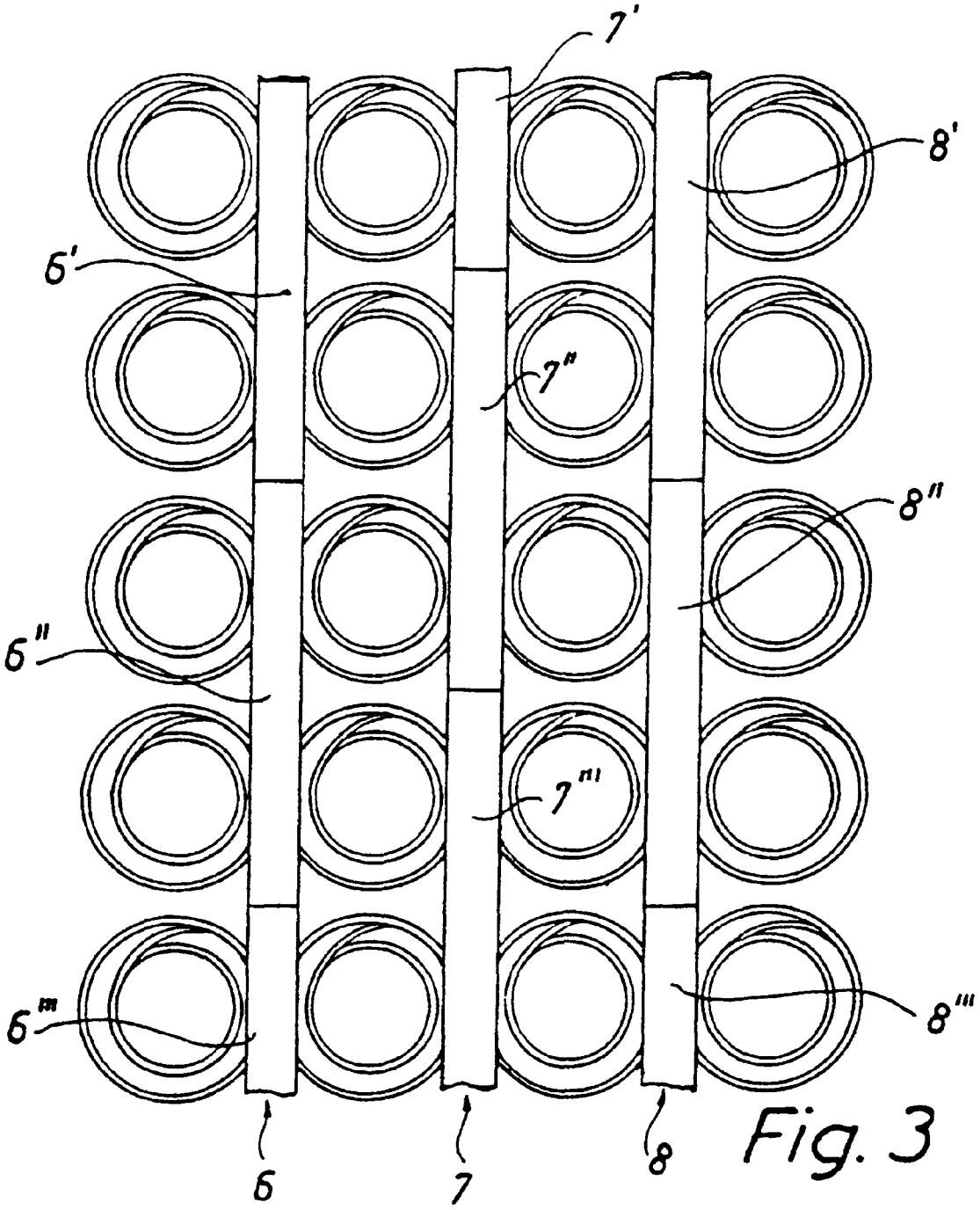
FIG. 3 is a view from above of a larger part of the spring mattress of FIG. 1 as seen from above.

It is advantageous to position the strip pieces in succession along lines 6, 7, 8, which extend in parallel with one another and in parallel with the plane of the mattress, as appears from FIG. 3. Each strip pieces thus preferably joins together several pairs of neighbouring springs, for instance two or three such pairs. In this manner, the springs of the mattress are joined together in all directions and co-operate to absorb pressure exerted on the mattress while at the same time the springs may be compressed comparatively independently of each other. The latter property is desirable both for reasons of comfort and for preventing displacement of the mattress sides, when a load is exerted on the middle region of the mattress.

The feature of dividing the strip pieces in the manner indicated above such that each individual spring is connected only to a small number of other springs is important, above all in the part of the layer that is turned towards the top of the mattress, i.e. in the turn 1*a* of the springs of FIG. 1. At the opposite end, on the other hand, such division is uncalled for, since the springs are not to be compressed from this direction. On the contrary, it might even be desirable to refrain from such division, as this contributes to the integrity of the mattress and to its firmness and stability. Preferably, the strip pieces 2*a* and 2*b* therefore are divided in the above-mentioned manner whereas the strip pieces 3*a* and 3*b* are not.

In addition, the strip pieces could be disposed in staggered relationship in the different lines 6, 7, 8 in the direction of extension of the individual lines. Thus, as shown in the illustrated embodiment, the strip pieces 6' in line 6 may be positioned in alignment with the strip pieces 8' in line 8, strip pieces 6" in alignment with strip pieces 8" and so on, whereas strip pieces 7' and 7" and so on, positioned in line 7 intermediate lines 6 and 8, may be displaced relative to the elements in lines 6 and 8 by a distance corresponding to one pair of springs. This staggered arrangement improves the stability and the integrity of the springs in the mattress.

Various joining methods may be used, such as welding, gluing, clamping by means of staples, clips or the like.

The strip pieces may be manufactured from a textile material, preferably of a kind that lends itself to welding. Other materials, such as e.q. plastics materials, are of course also possible.

The spring mattress and the method of manufacturing the same in accordance with the invention offer a number of advantages. The manufacturing process may be simplified, and consequently less expensive, while at the same time a more adaptable and individually resilient and therefore more comfortable mattress is produced.

The invention has been described above by means of one embodiment. Other varieties of the invention are, however, possible. For instance, other types of strip pieces are possible. Instead of strip pieces also short strip pieces or other kinds of surface elements may be used that join together only a couple of springs. It is likewise possible to use one piece of strip, which is attached directly to the spring wire, for instance by means of gluing, instead of, as suggested herein, by means of double strip pieces. It is likewise possible to join together the springs at turns in the interior of the springs instead of at external turns. Such varieties of the invention must be regarded as obvious and to be within the scope of protection of the invention as the latter is defined in the appended claims.

What is claimed is:

1. A spring mattress comprising:

a plurality of interconnected coil-spring elements;

strip pieces of a textile or plastics material, said strip pieces extending at least in one plane essentially in parallel with the plane of the mattress, wherein the strip pieces interconnect the coil-spring elements;

wherein pairs of said strip pieces extend between pairs of neighboring spring elements and are attached to one another by means of welding or gluing wherein parts of turns of the spring elements are sandwiched between the pairs of said strip pieces for interconnecting said spring elements; and wherein said strip pieces are attached to one another wherein at least one point of attachment will be located on the inner side of an associated spring of the pair of springs and at least one point of attachment will be located intermediate the spring elements.

2. The spring mattress as claimed in claim 1, wherein the strip pieces are assembled for grippingly enclosing parts of the turns of the spring elements while at the same time allowing some movability between the spring elements and the strip pieces.

3. The spring mattress as claimed in claim 1, wherein the strip pieces are arranged at least at one of the ends of the spring elements and preferably both at the top and at the bottom of said elements.

4. The spring mattress as claimed in claim 1, wherein those turns of the coil springs to which said strip pieces are attached have a larger radial extension, and in that those turns extend essentially in parallel with the plane of the mattress.

5. The spring mattress as claimed in claim 1, wherein the strip pieces extend between several pairs of coil springs.

6. The spring mattress as claimed in claim 5, wherein a number of strip pieces are arranged in succession in lines, which are parallel with the plane of the mattress, and in that a number of such lines run in an inter-parallel relationship, with the strip pieces in different lines being arranged in a staggered relationship in the direction of extension of said lines.

7. A method of manufacturing a spring mattress by joining together a number of coil springs in such a manner that they are interconnected, comprising the steps of:

placing a pair of strip pieces of a textile or plastics material between springs in one plane, which essentially is in parallel with the surface of the mattress, and attaching, for each pair of neighboring springs thus interconnected, said strip pieces to one another by means of at least one point of attachment located intermediate neighboring springs, and at least one point of attachment located on the inner side of the turns of associated springs.

8. The method as claimed in claim 7, wherein said strip pieces are attached to a number of pairs of neighboring springs, said spring elements extending in succession in parallel lines and said strip pieces being arranged in staggered relationship between such neighboring lines in the direction of extension of said lines.

9. A spring mattress comprising:

a plurality of interconnected coil-spring elements; and strip pieces of a textile or plastics material, said strip pieces extending at least in one plane essentially in parallel with the plane of the mattress, wherein the strip pieces interconnect the coil-spring elements;

wherein pairs of said strip pieces extend between pairs of neighboring spring elements and are attached to one another wherein parts of turns of the spring elements will be sandwiched between the pairs of strip pieces and thus interconnect said spring elements.

* * * * *